US011008072B2

(12) United States Patent
Abrisketa Lozano

(10) Patent No.: US 11,008,072 B2
(45) Date of Patent: May 18, 2021

(54) TENSIONER OF A MOORING LINE OF A FLOATING STRUCTURE

(71) Applicant: VICINAY CADENAS S.A., Bilbao (ES)

(72) Inventor: Nagore Abrisketa Lozano, Leioa (ES)

(73) Assignee: VICINAY CADENAS, S.A., Bilbao (ES)

( * ) Notice: Subject to any disclaimer, the term of this patent is extended or adjusted under 35 U.S.C. 154(b) by 0 days.

(21) Appl. No.: 16/986,496

(22) Filed: Aug. 6, 2020

(65) Prior Publication Data

US 2020/0377178 A1 Dec. 3, 2020

Related U.S. Application Data

(63) Continuation of application No. PCT/ES2018/070156, filed on Mar. 2, 2018.

(51) Int. Cl.
*B63B 21/10* (2006.01)
*B63B 21/20* (2006.01)
(Continued)

(52) U.S. Cl.
CPC ..... *B63B 21/50* (2013.01); *B63B 21/04* (2013.01); *B63B 2021/505* (2013.01)

(58) Field of Classification Search
CPC ... B63B 21/50; B63B 21/04; B63B 2021/505; B63B 21/10; B63B 21/18; B63B 21/20;
(Continued)

(56) References Cited

U.S. PATENT DOCUMENTS 3,880,105 A * 4/1975 Bryant ..... B63B 21/50 114/294
4,175,620 A * 11/1979 Nolan, Jr. ..... E21B 43/0135 166/343
(Continued)

FOREIGN PATENT DOCUMENTS

CN 103640672 A 3/2014
EP 1283158 A1 2/2003
(Continued)

OTHER PUBLICATIONS

International Search Report and Written Opinion received in international application No. PCT/ES2018/070156, dated Oct. 10, 2018 (12 pages).

*Primary Examiner* — Edwin J Toledo-Duran
(74) *Attorney, Agent, or Firm* — Edell, Shapiro & Finnan, LLC

(57) ABSTRACT

A tensioning system of a mooring line of a floating structure. The mooring line includes separate first and second mooring line sections, with a first end of the second mooring line attached to the floating structure and a first end of the first mooring line section being attached to an anchoring device embedded in a seabed. A tensioner configured to act on the mooring line includes a body with a housing, and an inlet unit for inserting a second end of the first mooring line section into the housing of the body. The body includes an opening for the passage of a second end of the first mooring line section from the inlet unit, through the housing, and along a direction changing element. The tensioning system includes a stabilizing platform fixed to the body. At least a portion of the stabilizing platform laterally projects from the body of the tensioner.

20 Claims, 7 Drawing Sheets

(51) Int. Cl.
*B63B 21/50* (2006.01)
*B63B 21/18* (2006.01)
*B63B 21/04* (2006.01)

(58) Field of Classification Search
CPC ..... B63B 2021/003; B63B 2021/004; B63B 2021/20
USPC ..... 114/199, 200, 204, 205, 210, 213, 215, 114/216, 217, 230.1, 230.2, 230.21, 114/230.22, 230.24, 230.25, 230.26, 114/230.27, 230.28, 230.29, 293
See application file for complete search history.

(56) References Cited

U.S. PATENT DOCUMENTS 4,186,464 A * 2/1980 Sandoy ..... B63B 21/18 24/116 R
5,934,216 A * 8/1999 Childers ..... B63B 21/04 114/230.1
6,431,102 B1 * 8/2002 Askestad ..... B63B 21/14 114/200
7,240,633 B2 * 7/2007 Barlow ..... B63B 21/04 114/200
9,567,039 B2 * 2/2017 Busson ..... B63B 21/10
9,975,606 B2 * 5/2018 Trouve ..... B63B 21/10
10,780,952 B1 * 9/2020 Doss ..... B63B 21/50
2002/0176747 A1 * 11/2002 Hanna ..... B63B 21/502 405/224
2011/0162748 A1 * 7/2011 Morand ..... F16L 1/15 138/109
2011/0293379 A1 * 12/2011 Halkyard ..... E02D 7/06 405/224
2014/0069657 A1 * 3/2014 Povloski ..... E21B 17/015 166/345
2016/0059943 A1 * 3/2016 Chitwood ..... B63C 7/12 114/51
2016/0185427 A1 * 6/2016 Macrae ..... B63B 21/50 114/230.22
2016/0258553 A1 * 9/2016 Zhang ..... F16L 1/20
2019/0161145 A1 * 5/2019 Trouve ..... B63B 21/50
2019/0352878 A1 * 11/2019 Wallerand ..... E02D 27/52

FOREIGN PATENT DOCUMENTS

EP 2130759 A2 12/2009
WO 2014083056 A1 6/2014

* cited by examiner

TENSIONER OF A MOORING LINE OF A FLOATING STRUCTURE

CROSS-REFERENCE TO RELATED APPLICATIONS

This application relates to and claims the benefit and priority to International Application No. PCT/ES2018/070156, filed Mar. 2, 2018.

TECHNICAL FIELD

The present invention relates to tensioners of mooring lines of floating structures.

BACKGROUND

Floating structures, such as drilling vessels or offshore platforms, have to be moored to the seabed in a given fixed area, so as to not be subjected to the displacements that may be caused by sea currents or atmospheric conditions. Anchoring devices of different types which are moored to mooring lines that are attached to the vessels or platforms are used. Initially, when floating structures are moored to the seabed the mooring lines must be tensioned in order to keep the floating structures in place. Over time, the mooring lines loosen and they must be tensioned again. The mooring lines are tensioned with tensioners.

US20160185427A1 describes a tensioner of a mooring line of a floating structure, the mooring line comprising a first mooring line and a second mooring line, with the mooring lines being separate from one another, wherein one of the mooring lines comprises a first end attached to the floating structure, and the other mooring line comprises a first end attached to an anchoring device which is secured to the seabed, the tensioner comprising an elongated body with a base and a longitudinal housing configured for housing a chain segment of the first mooring line, a connection unit attached to the body at one of its ends comprising a connector member configured for attaching a second end of the second mooring line to the body, and an inlet unit attached to the body at the other end and configured for inserting a second end of the first mooring line into the housing of the body, the body comprising an opening in the upper part for the passage of the second end of the first mooring line from the inlet unit, through the housing, and along a direction changing element.

SUMMARY

Disclosed is a tensioner of a mooring line of a floating structure.

The tensioner of the invention is a tensioner of a mooring line of a floating structure, wherein the mooring line comprises a first mooring line and a second mooring line, with the mooring lines being separate from one another, wherein one of the mooring lines comprises a first end attached to the floating structure, and the other mooring line comprises a first end attached to an anchoring device which is secured to the seabed, the tensioner comprising an elongated body with a base and a longitudinal housing configured for housing a chain segment of the first mooring line, a connection unit attached to the body at one of its ends comprising a connector member configured for attaching a second end of the second mooring line to the body, and an inlet unit attached to the body at the other end and configured for inserting a second end of the first mooring line into the housing of the body, the body comprising an opening in the upper part for the passage of the second end of the first mooring line from the inlet unit, through the housing, and along a direction changing element.

The tensioner comprises a stabilizing platform, with the body being fixed to the stabilizing platform and the stabilizing platform projecting laterally from the body.

Due to the existence of sea currents and/or adverse atmospheric conditions, the tensioner may sustain large displacements, and less tension in the mooring line that what is required, or even a break thereof, may thereby occur. The tensioner is stabilized with the stabilizing platform, and fewer rocking movements occur in the tensioner and in the mooring line. The stabilizing platform protects the direction changing element against direct impacts of any object that may be in the water. If the tensioner is arranged close to the anchoring device, on the seabed, which furthermore allows the tensioner to act as an added anchoring device, the stabilizing platform, if it has the required dimensions, protects the direction changing element against contact with the seabed and allows being able to see the direction changing element better.

These and other advantages and features will become evident in view of the drawings and detailed description.

DETAILED DESCRIPTION

The mooring of a drilling vessel or production vessel, or an offshore platform, with an anchoring device, whether it is an anchor or a pile driven into the seabed, is done by attaching one or more mooring lines thrown from the vessel or offshore platform, with a chain segment which is attached to the anchoring device. The mooring lines can be a chain in their entirety, or a rope or set of steel and/or polyester ropes ending in a chain segment, which is attached to the chain segment attached to the anchoring device.

Figure 1:
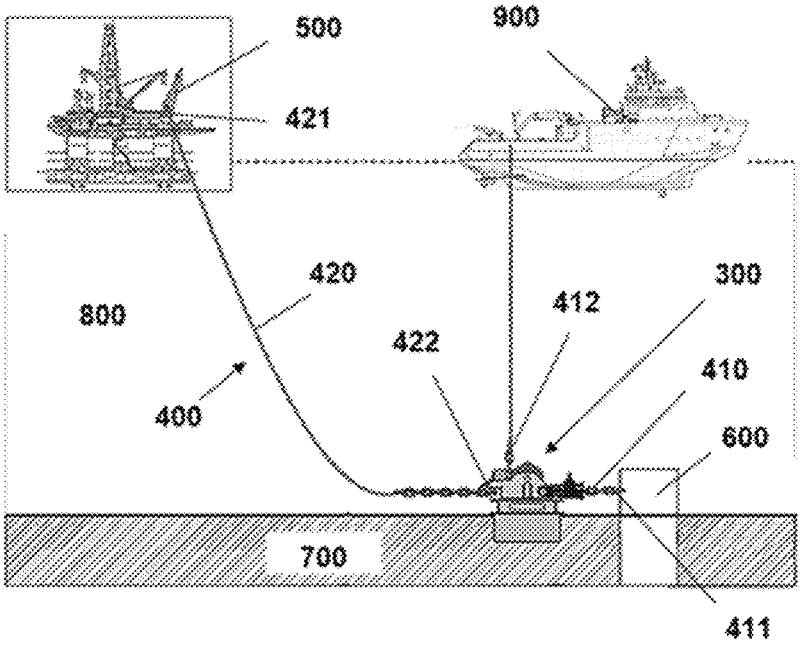
FIG. 1 shows a schematic view of an arrangement of the tensioner of a mooring line of a floating structure, wherein the tensioner is arranged close to an anchoring device on the seabed.

FIG. 1 shows a schematic view of an arrangement of the tensioner 300 of a mooring line 400 of a floating structure 500 of the invention, wherein the tensioner 300 is arranged close to an anchoring device 600, which can interchangeably be an anchor or a pile, and is secured to the seabed 700. In this embodiment, the mooring line 400 comprises a first mooring line 410 formed by a chain, with a first end 411 of the chain being attached to the anchoring device 600 and a second end 412 passing through the tensioner 300 and being attached to a rope coming from a vessel 900 used for pulling the first mooring line through the rope, and thereby pulling and tautening the mooring line 400. The mooring line 400 further comprises a second mooring line 420 separate from the first mooring line 410. This second mooring line 420 is formed by a rope segment and a chain segment, the second mooring line 420 comprising a first end 421 which consists of rope and is attached to the floating structure 500, and a second end 422 which consists of chain and is attached to the tensioner 300. Once the mooring line is tensioned from the ship 900, the tensioner 300 can be left in standby on the seabed 700, and even with the surplus of the first and second ends 411 and 412 also resting on the seabed 700, it can be used in this case as an added anchoring device for the mooring line 400.

Figure 2:
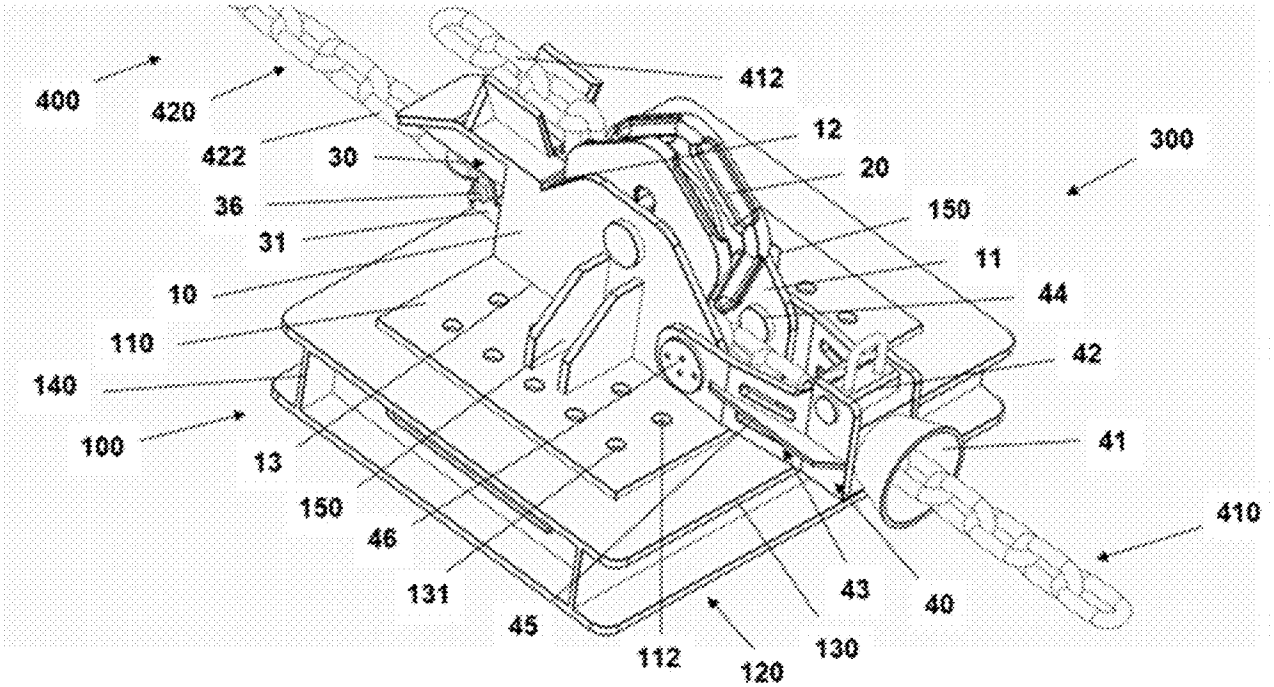
FIG. 2 shows a perspective view of an embodiment of the tensioner of a mooring line of a floating structure, wherein the tensioner comprises a sheave and a stabilizing platform comprising a plate and a structure.

FIG. 2 shows a perspective view of an embodiment of the tensioner 300 of the mooring line 400 of a floating structure 500, comprising separate first and second mooring lines 410 and 420 with the tensioner 300. The tensioner 300 comprises an elongated body 10 with a base 13 and a longitudinal housing 11 configured for housing a chain segment of the first mooring line 410. The body 10 comprises, attached thereto, a connection unit 30 at one of its ends, the connection unit 30 comprising a connector member 31 which is configured for attaching a second end 422 of the second mooring line 420 to the body 10. The body 10 also comprises, attached at the other end, an inlet unit 40 which is configured for inserting a second end 412 of the first mooring line 410 into the housing 11 of the body 10.

The body 10 comprises an opening 12 in the upper part for the passage of the second end 412 of the first mooring line 410 from the inlet unit 40, which passes through the longitudinal housing 11, and exits through the opening 12 along a direction changing element. This direction changing element allows diverting the second chain end 412 from the inlet direction in the inlet unit 40, towards the pulling direction defined by the ship 900 on the surface of the water.

Due to the existence of sea currents and/or adverse atmospheric conditions, the tensioner 300 can sustain large displacements, rocking, and even turns, and the mooring line 400 may thereby become loose, or breaking may even occur. The tensioner 300 comprises a stabilizing platform 100 for the purpose of keeping the tensioner 300 as stable as possible. To that end, the body 10 of the tensioner 300 is fixed to the stabilizing platform 100. Once the stabilizing platform 100 is fixed to the tensioner 300, the stabilizing platform 100 projects laterally from the body 10.

Figure 3:
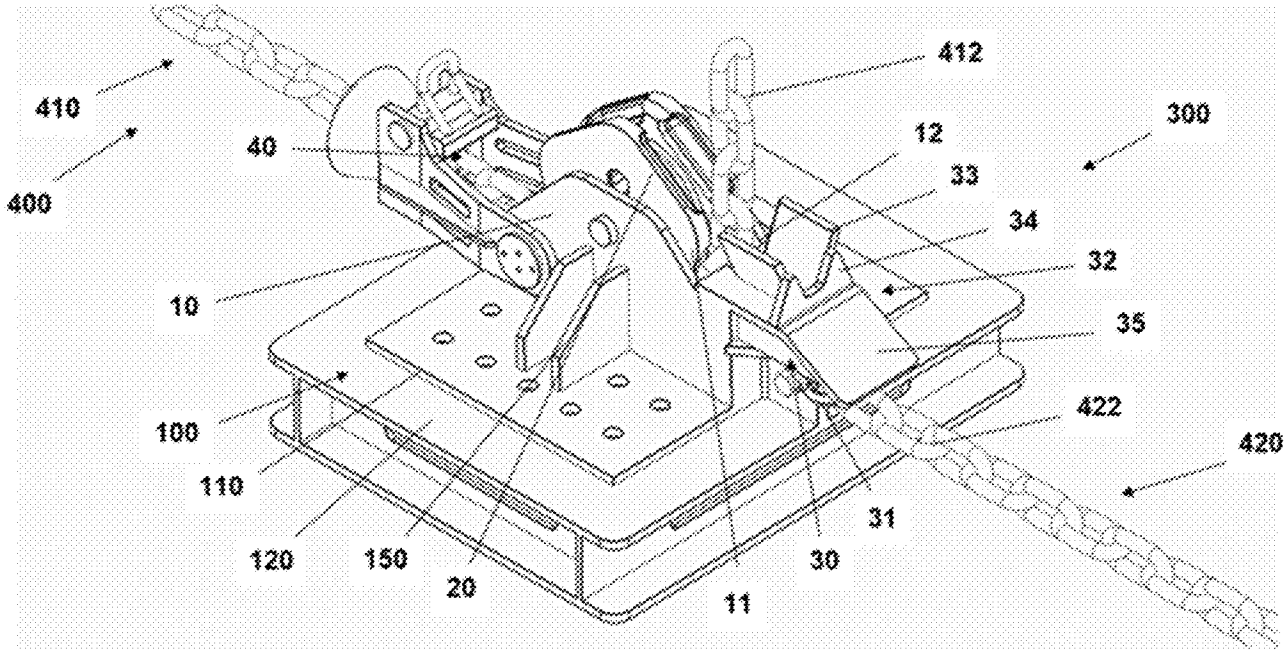
FIG. 3 shows a second perspective view of the tensioner of FIG. 2.

This attachment of the body 10 of the tensioner 300 to the stabilizing platform 100 can be done in several ways and with different configurations of both parts. In that sense, in FIG. 2 the tensioner 300 comprises a direction changing element, which is a sheave 20, and a stabilizing platform 100 comprising a plate 110 and a structure 120, and FIG. 3 shows a second perspective view of the tensioner 300 of FIG. 2.

The body 10 of this embodiment of the tensioner 300 is formed by two separate, parallel and elongated vertical plates fixed to the horizontal base 13, with the longitudinal housing 11 being the space configured between the two vertical plates and the horizontal base 13, which allows housing the sheave 20 which is rotatably coupled to the vertical plates, and the chain segment of the first mooring line 410. This chain segment is the second end 412 which, after being guided into the housing 11 by a guide arranged on the inner face of the base 13 (not shown in the drawings), is supported in the sheave 20, which provides an outlet in the direction of the ship 900 from where the segment is being pulled.

In this embodiment of the tensioner 300, the base 13 of the body 10 is fixed to the stabilizing platform 100, but in other embodiments of the tensioner the stabilizing platform can be fixed on a side of the body, for example. In this embodiment of the tensioner 300, the stabilizing platform 100 comprises a plate 110 on which the body 10 is arranged. This plate 110, which projects laterally from the body 10, comprises a plurality of through holes 112. The function of these holes 112 is to prevent sand or other elements existing in the water 800 from building up in the stabilizing platform 100. In other embodiments of the tensioner (not shown in the drawings), the plate may not be a horizontal plate, but rather it may be formed by a set of attached plates forming different angles with one another.

The stabilizing platform 100 of the tensioner 300 of the embodiment that is shown further comprises a structure 120. In this embodiment, this structure 120 comprises two plates 130, an upper plate and another lower plate, which are superimposed on and separate from one another by a certain distance. To maintain this separation distance, the two plates 130 are attached by four vertical profiles 140, which allows the plates 130 to be parallel to one another. In other embodiments of the tensioner (not shown in the drawings), the structure may comprise a larger number of plates, and/or it may comprise another number of profiles attaching the plates to one another, for example two, and/or the plates of the structure are not parallel, being attached in that case by means of profiles having different dimensions.

In the embodiment of the tensioner 300 that is shown, the plate 110 is fixed, for example by means of welding or by means of screws, to the upper plate 130 of the structure 120. Each of the two upper and lower plates 130 comprises a plurality of through holes 131 on the surface thereof, such that sand or other elements in the water built up in the stabilizing platform 100 may be discharged through the through holes 112 of the plate 110 and through the through holes 131 of the plates 130 of the structure 120 of the stabilizing platform 100.

The profiles 140 that allow the plates 130 of the structure 120 to be attached to one another demarcate closed contours. In the tensioner 300 that is shown, the four vertical profiles 140 close the space existing between the two horizontal plates 130. To make it easier to discharge sand or other elements that may build up in the space, including water, the profiles 140 each comprise an elongated horizontal opening 142.

Figure 8:
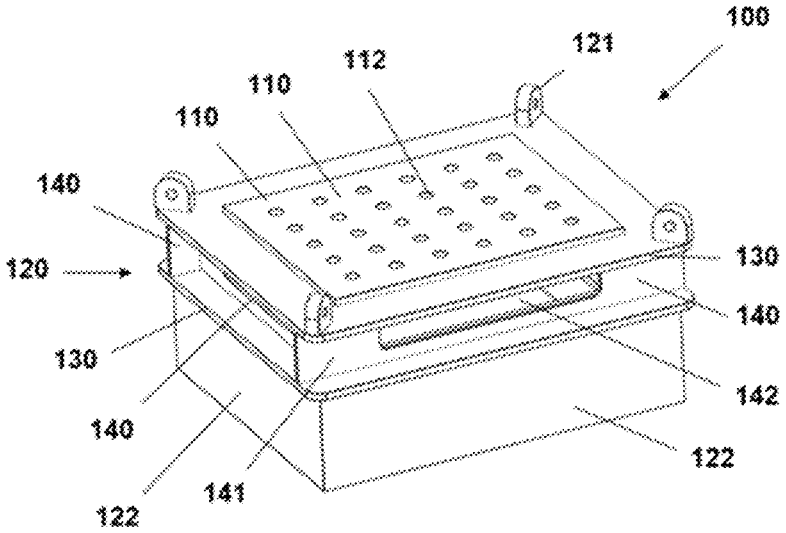
FIG. 8 shows a perspective view of an embodiment of the stabilizing platform of the tensioner, wherein the stabilizing platform comprises a plate and a structure, and the structure comprises vertical plates.

FIG. 8 shows a perspective view of an embodiment of the stabilizing platform 100 of the tensioner 300 of the invention, wherein the stabilizing platform 100 comprises a plate 110 and a structure 120 like those shown in FIGS. 2 and 3 of the embodiment of the tensioner 300. Furthermore, the structure 120 comprises four vertical plates 122 which are arranged fixed on the edges of each of the sides of the lower plate 130, the vertical plates 122 projecting downwards from the lower plate 130. The essential function of the vertical plates 122 is carried out when the tensioner 300 is arranged next to the anchoring device 600, and after the mooring line 400 has been tensioned, the tensioner 300 is supported on the seabed 700. The vertical plates 122 are driven into the seabed 700, which helps the tensioner 300 to remain immobile and more stable. In this embodiment of the stabilizing platform 100, the structure 120 comprises four connector members 121 which are arranged fixed in each of the vertices of the upper plate 130. The function of the connector members 121 is to allow the connection to different pulling ropes, which in turn allow moving, in or out of the water, the tensioner 300 or the stabilizing platform 100 separately.

The body 10 and the stabilizing platform 100 of the tensioner 300 can be fixed by means of welding, so they would form a single part, but the tensioner 300 may also comprise coupling means 150 for coupling the body 10 and the stabilizing platform 100, as in the case of the embodiment of the tensioner shown in FIGS. 2 and 3. In the embodiment of the tensioner 300, the coupling means 150 are two brackets arranged on each side of the body 10, with one face being supported on the body 10 and the other face being supported on the plate 110 of the stabilizing platform 100. The attachment is by means of screws which are concealed and which are arranged going through the vertical walls of the body 10 and in the plate 110, and they are housed in threaded holes arranged in the brackets of the coupling means 150. The body 10 and the stabilizing platform 100 are thereby made separable, thereby making it easier to transport and assemble the tensioner 300.

Figure 4:
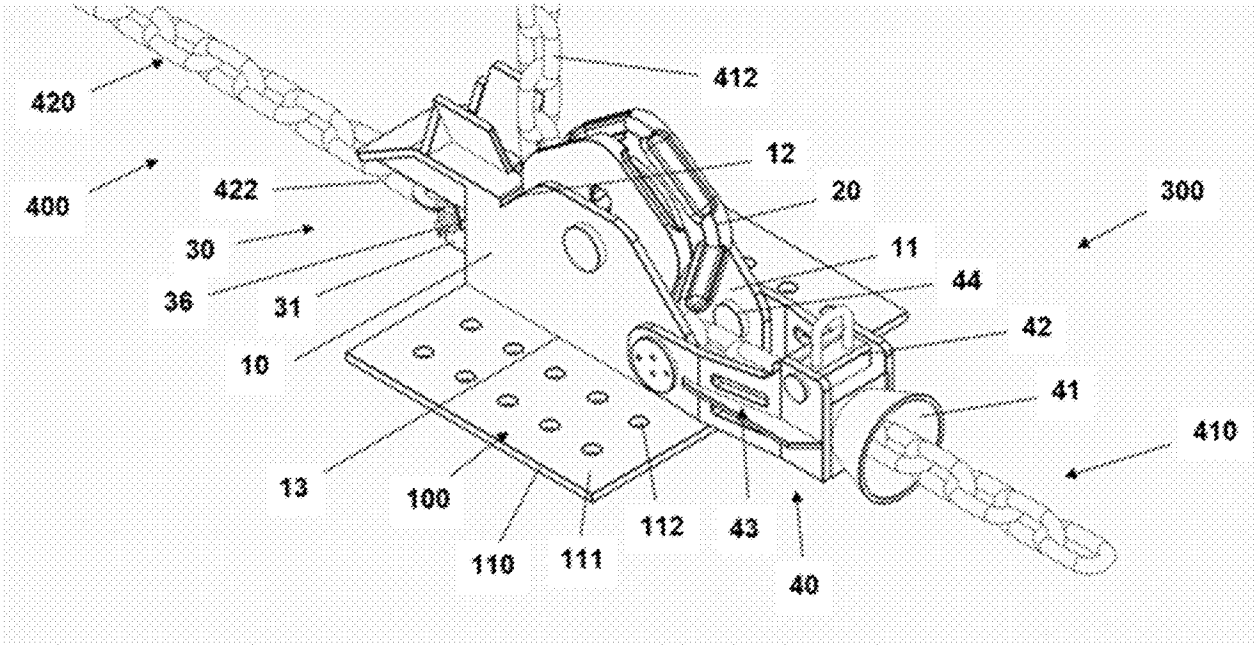
FIG. 4 shows a perspective view of a second embodiment of the tensioner of a mooring line of a floating structure, wherein the tensioner comprises a sheave and a stabilizing platform comprising a plate.

FIG. 4 shows a perspective view of a second embodiment of the tensioner 300 of a mooring line 400 of a floating structure 500 of the invention, wherein the tensioner 300 also comprises a sheave 20 like in the first embodiment, but in this second embodiment the stabilizing platform 100 comprises only one plate 110. The remaining features of the tensioner 300 are the same in the first and second embodiments. Both in the first and in the second embodiment of the tensioner 300, the sheave 20 allows arranging the second end 412 of the first mooring line 410 at an angle of the outlet direction as pulled from the ship 900 that is greater than 90°, which allows providing greater flexibility when tautening the mooring line 400. The second embodiment of the tensioner 400 is more lightweight and less expensive.

Other common features of the first and second embodiments of the tensioner 300 are the connection unit 30 and the inlet unit 40.

The connection unit 30 comprises, in addition to the connector member 31, a guiding and protection device 32 comprising a support surface for the second end 412 of the first mooring line 410 when it is not in use. The guiding and protection device 32 is arranged fixed to a vertical wall of the body 10, closing one end of the vertical walls forming the body 10, and therefore closing the longitudinal housing 11 of the body 10. The connector member 31 is fixed to the vertical wall and the guiding and protection device 32 is axially projected over the connector member 31 in the body 10. This guiding and protection device 32 comprises a cradle 33, followed by a V-shaped wedge 34, and a downwardly inclined outlet ramp 35, forming the support surface for the second end 412. When the mooring line 400 has been tensioned, and the first mooring line 410 has been released from the ship 900 by drawing in the rope attached to the second end 412, the second end may become tangled with the second end 422 of the second mooring line 420. With the guiding and protection device 32, the second end 412 of the first mooring line 410 would be supported, which prevents it from getting mixed up with the second end 422 of the second mooring line 420.

The inlet unit 40 comprises a cross-shaped inlet element 41, i.e., a hollow, frustoconical-shaped part which internally comprises a wall with a hole in the shape of a cross, and having dimensions suited to the size of the horizontal and vertical links of the chain forming the second end 412 of the first mooring line 410. After the inlet element 41, and in the direction of insertion of the second end 412, the inlet unit 40 comprises a retaining device 42 for retaining the chain. This retaining device 42 is coupled to the inlet element 41 and is rotatable in a vertical plane. The retaining device 42 comprises a rotatable vertical wall comprising on its inner face a through hole for the vertical links of the chain, and a notch on the face on the sides of the through hole, and having the dimensions and being in the position of the horizontal links of the chain. Therefore, when the second end 412 is pulled, the links of the chain go through and are guided into the inlet element 41, and as the horizontal links pass through the retaining device 42, they lift up the retaining device 42, making it rotate. When the mooring line 400 has been tensioned, the second end 412 of the first mooring line 410 is released. In order for the chain not to slip backwards, the horizontal link of the chain that is next to the retaining device 42 is retained by the notch of the inner face of the rotatable vertical wall.

The inlet unit 40 of these first and second embodiments of the tensioner 300 comprises a tilting device 43, which is coupled in a vertically rotatable manner to the vertical walls of the body 10 on a rotating shaft 44. The tilting device 43 comprises an inclinometer 45 which is arranged on one side and used to measure the angle that the tilting device 43 rotates, and a limiter 46 which is arranged on the rotating shaft 44 for limiting rotation and used to limit the rotation of the tilting device 43 at a given angle. The inlet element 41 and the retaining device 42 of the inlet unit 40 are arranged assembled in the tilting device 43, such that the inclinometer 45 measures the angle that the second end 412 of the first mooring line 410 is being rotated while the mooring line 400 is being tensioned, this being an indirect way to calculate the tension obtained in the mooring line 400. The limiter 46 allows limiting the angle at which the second end 412 is arranged with respect to the plane of the base 13 of the body 10 of the tensioner 300.

Figure 5:
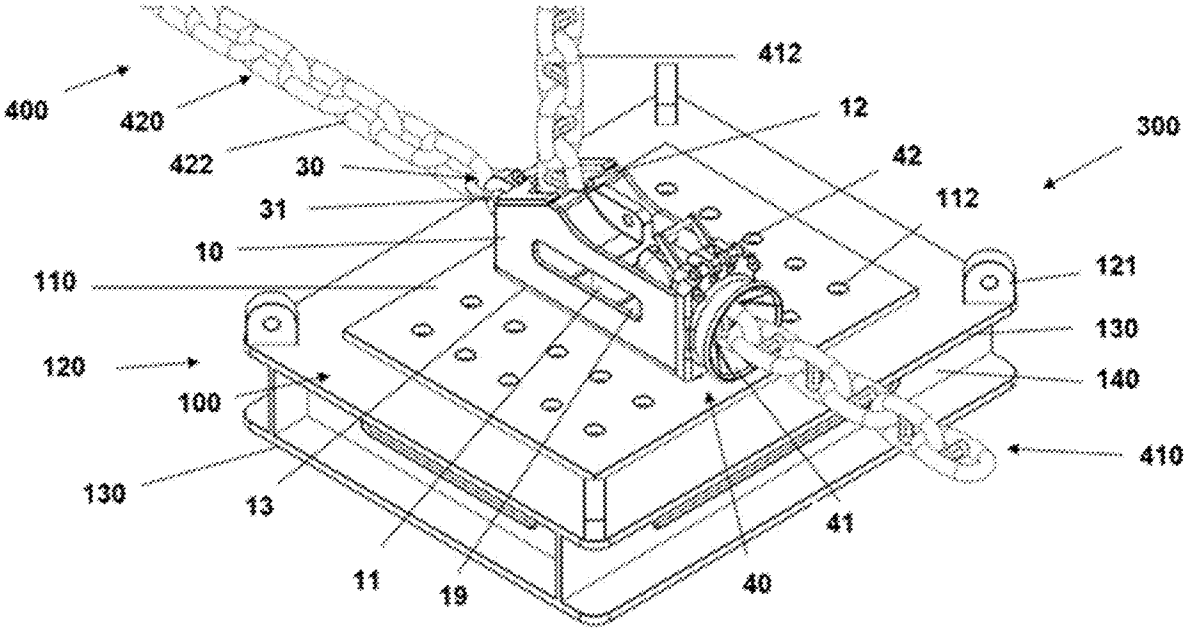
FIG. 5 shows a perspective view of a third embodiment of the tensioner of a mooring line of a floating structure, wherein the tensioner comprises a body with a curved upper wall, and a stabilizing platform comprising a plate and a structure.
Figure 6:
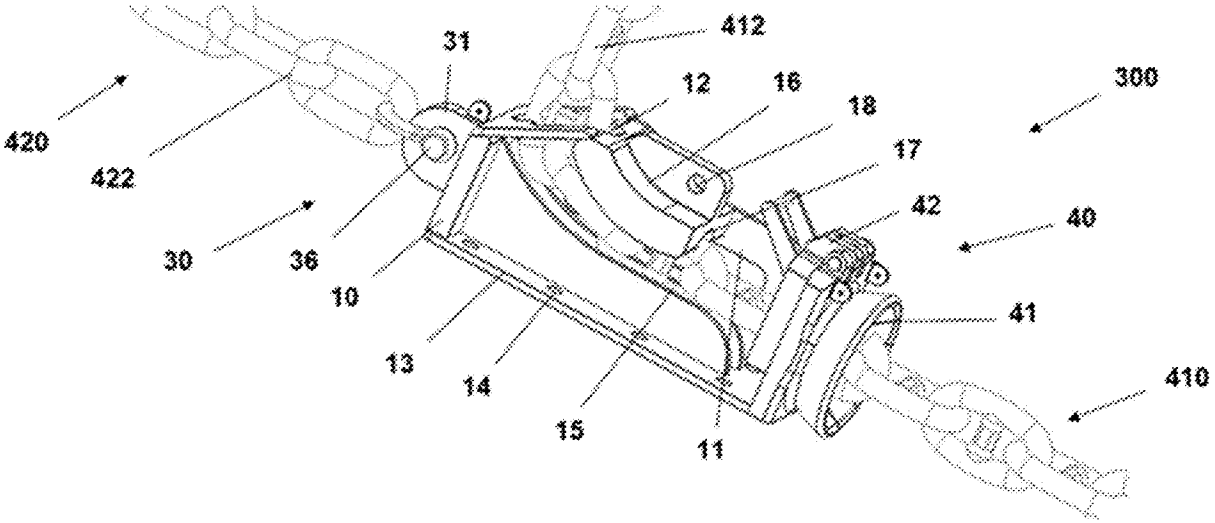
FIG. 6 shows a perspective section view of the tensioner of FIG. 5 without a stabilizing platform, showing the internal guiding of the second end of the first mooring line.

FIG. 5 shows a perspective view of a third embodiment of the tensioner 300 of a mooring line 400 of a floating structure 500 of the invention, wherein the tensioner 300 comprises a body 10 with a curved upper wall 16, and a stabilizing platform 100 comprising a plate 110 and a structure 120. FIG. 6 shows a perspective section view of the tensioner 300 of FIG. 5 without the stabilizing platform 100, showing the internal guiding of the second end 412 of the first mooring line 410.

The body 10 of this embodiment of the tensioner 300 is a substantially prismatic body, with a horizontal base 13, two separate, parallel and elongated vertical walls fixed to the horizontal base 13, a vertical wall at one end wherein the connection unit 30 is attached to the connector member 31, an opposite end wherein the inlet unit 40 is coupled, and the curved upper wall 16. The longitudinal housing 11 is the space configured between the two vertical walls, the horizontal base 13, and the upper wall 16.

Figure 7:
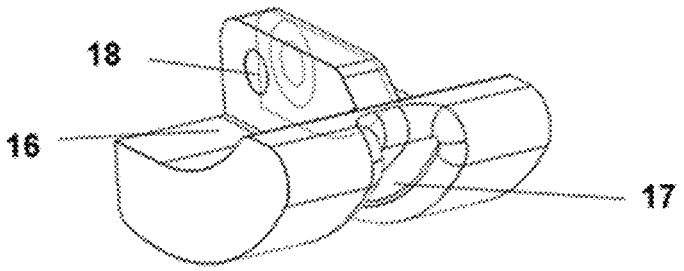
FIG. 7 shows a perspective view of the curved upper wall of the body of the tensioner of FIG. 5.

In this embodiment of the tensioner 300, the direction changing element is, as shown in detail in FIG. 7, the curved upper wall 16. The upper wall 16 comprises on its inner face a guide 17 for the vertical links of the second end 412 of the first mooring line 410, and comprises on its outer face, in a vertical wall, a through hole 18 which is used for transporting and/or for holding the tensioner 300 from a ship with a rope attached to the hole 18 while the mooring line 400 is tensioned. The base 13 comprises on its inner face a guide 15 for the vertical links of the second end 412, and it is arranged opposite guide 17, such that the second end 412 is guided with guides 15 and 17 and exits through an opening 12 of the housing 11 arranged where the curved upper wall 16 ends.

The curved upper wall 16 allows arranging the second end 412 of the first mooring line 410 at an angle of the outlet direction as pulled from the ship 900 that is less than 90°, which gives the tensioner 300 better qualities for being arranged fixed directly to the floating structure 500.

In this third embodiment of the tensioner 300, the base 13 of the body 10 is fixed to the stabilizing platform 100, but in other embodiments of the tensioner the stabilizing platform can be fixed on one side of the body, for example. The base 13 comprises a plurality of through holes 14, just like the base 13 of the body 10 of the tensioners 300 of the first and second embodiments (not shown in the drawings). Sand or other elements in the water that may be retained inside the body 10 can thereby be discharged by means of the through holes 14 of the base 13, and they can then be discharged from the stabilizing platform 100 by means of the through holes 112 of the plate 110, the through holes 131 of the vertical plates 130, and the openings 142 of the profiles 140 of the structure 120.

In this third embodiment of the tensioner 300, the features of the stabilizing platform 100 are the same as those described for the first and second embodiments of the tensioner 300. With the features of the tensioner defined in that sense, and specifically with the features of the stabilizing platform 100, the direction changing element for the second end 412 of the first mooring line 410 is protected against direct impacts of other elements, and at the same time, and especially when the tensioner is arranged next to the anchoring device 600 on the seabed 700, the direction changing element is more visible for the maneuvers to be carried out in the water 800.

The connection unit 30 comprises only the connector member 31, and the inlet unit 40 comprises only the cross-shaped inlet element 41 and the retaining device 42 with the features described for the first and second embodiments of the tensioner 300.

The connection unit 30 of any of the three embodiments of the tensioner 300 that are shown comprises a connector member 31 where the second end 422 of the second mooring line 420 is attached. In the connector member 31, there is arranged an assembly bolt in which there is arranged a load cell 36 for measuring the tension of the mooring line 400, such that it is possible to directly monitor the tension of the mooring line 400.

What is claimed is:

1. A tensioning system for a mooring line of a floating structure, the tensioning system configured for placement on a seabed of a sea, the mooring line including separate first and second mooring line sections, the first mooring line section including first and second ends, the first end of the first mooring line section configured to be secured to an anchoring device secured in a seabed, the second mooring line section including first and second ends, the first end of the second mooring line section configured to be secured to the floating structure, the tensioning system comprising:

a tensioner configured to act on the mooring line, the tensioner including a body with a housing, and an inlet unit for inserting the second end of the first mooring line section into the housing of the body, the body including an opening for the passage of the second end of the first mooring line section from the inlet unit, through the housing, and along a direction changing element; and a stabilizing platform to which the body of the tensioner is coupled, the stabilizing platform configured to rest on the seabed, the stabilizing platform including an upper plate and a lower plate, the upper and lower plates being coupled to one another by a plurality of vertical profiles that are coupled to one another to demarcate a closed contour, at least one of the vertical profiles including a side opening that opens to the sea and is configured to facilitate a discharge of sand and/or water from a space bounded by the upper and lower plates and the plurality of vertical profiles, at least a portion of the stabilizing platform laterally projecting from the elongated body of the tensioner.

2. The tensioning system according to claim 1, wherein the base of the body is fixed to the stabilizing platform.

3. The tensioning system according to claim 1, wherein the base of the body includes a plurality of through holes.

4. The tensioning system according to claim 1, wherein the stabilizing platform includes a base plate fixed to the body of the tensioner.

5. The tensioning system according to claim 4, wherein the base plate includes a plurality of through holes.

6. The tensioning system according to claim 1, wherein the upper and lower plates of the stabilizing platform are each arranged horizontal and positioned parallel to one another.

7. The tensioning system according to claim 1, wherein each of the plurality of vertical profiles includes a side opening that opens to the sea and is configured to facilitate the discharge of sand and/or water from the space.

8. The tensioning system according to claim 1, wherein the upper plate includes a plurality of through holes.

9. The tensioning system according to claim 5, wherein the upper plate includes a plurality of through holes in fluid communication with the plurality of through holes in the base plate.

10. The tensioning system according to claim 1, further comprising a structure attached to the lower plate, the structure including a plurality of vertically elements protruding downward from the lower plate and configured to be driven into the seabed.

11. The tensioning system according to claim 1, wherein the upper plate includes at least one connector member.

12. The tensioning system according to claim 1, wherein the direction changing element is a curved upper wall of the body, the upper wall comprising on an inner face a first guide for the second end of the first mooring line section, and the base of the body including on an inner face a second guide for the second end of the first mooring line section, the second guide being opposite the first guide, the end of the upper wall being arranged next to the opening of the housing of the body.

13. The tensioning system according to claim 1, further comprising a connection unit attached to a first end of the body, the connection unit including a connector member configured to attach the second end of the second mooring line section to the body, the connection unit including a guiding and protection device configured to guide and protect the second end of the first mooring line section when not in use, the guiding and protection device projecting over the connector member, the guiding and protection device including a support surface for the second end of the first mooring line section.

14. The tensioning system according to claim 13, wherein the guiding and protection device includes a cradle, followed by a V-shaped wedge, and an outlet ramp, the support surface comprising the cradle, the wedge, and the ramp.

15. The tensioning system according to claim 1, wherein the inlet unit includes a tilting device coupled in a vertically rotatable manner to the body on a rotating shaft, the tilting device including an inclinometer for measuring an angle of rotation of the tilting device, and a limiter which is arranged on the rotating shaft for limiting rotation of the tilting device, an inlet element and a retaining device for the second end of the first mooring line section being arranged assembled in the tilting device.

16. A tensioning system for a mooring line of a floating structure, the tensioning system configured for placement on a seabed of a sea, the mooring line including separate first and second mooring line sections, the first mooring line section including first and second ends, the first end of the first mooring line section configured to be secured to an anchoring device secured in a seabed, the second mooring line section including first and second ends, the first end of the second mooring line section configured to be secured to the floating structure, the tensioning system comprising:

a tensioner comprising:

an elongated body with a base and a longitudinal housing configured to house a chain segment of the first mooring line, a connection unit attached to a first end of the elongated body, the connection unit including a connector member configured to attach the second end of the second mooring line section to the elongated body, an inlet unit attached to a second end of the elongated body configured to receive a second end of the first mooring line section into the longitudinal housing, the elongated body having an opening in an upper part opposite the base, the opening configured to provide a passage of the second end of the first mooring line section from the inlet unit, through the longitudinal housing, and along a direction changing element; and a stabilizing platform to which the elongated body of the tensioner is coupled, the stabilizing platform configured to rest on the seabed, the stabilizing platform including an upper plate and a lower plate, the upper and lower plates being coupled to one another by a plurality of vertical profiles that are coupled to one another to demarcate a closed contour, at least one of the vertical profiles including a side opening that opens to the sea and is configured to facilitate a discharge of sand and/or water from a space bounded by the upper and lower plates and the plurality of vertical profiles, at least a portion of the stabilizing platform laterally projecting from the elongated body of the tensioner.

17. The tensioning system according to claim 16, wherein the base of the elongated body is fixed to the stabilizing platform.

18. The tensioning system according to claim 16, wherein the base includes a plurality of through holes.

19. The tensioning system according to claim 16, wherein the stabilizing platform includes a base plate fixed to the elongated body of the tensioner.

20. The tensioning system according to claim 19, wherein the base plate includes a plurality of through holes.

* * * * *